US010219638B2

(12) United States Patent
Wood et al.

(10) Patent No.: US 10,219,638 B2
(45) Date of Patent: Mar. 5, 2019

(54) REFRIGERATED DISPLAY APPLIANCES

(71) Applicant: Applied Design and Engineering Ltd, Lowestoft, Suffolk (GB)

(72) Inventors: Ian Wood, Lowestoft (GB); Edward Hammond, Lowestoft (GB)

(73) Assignee: Applied Design and Engineering Ltd. (GB)

( * ) Notice: Subject to any disclaimer, the term of this patent is extended or adjusted under 35 U.S.C. 154(b) by 345 days.

(21) Appl. No.: 14/889,900

(22) PCT Filed: May 12, 2014

(86) PCT No.: PCT/GB2014/051452

§ 371 (c)(1),
(2) Date: Nov. 9, 2015

(87) PCT Pub. No.: WO2014/181136

PCT Pub. Date: Nov. 13, 2014

(65) Prior Publication Data

US 2016/0113419 A1 Apr. 28, 2016

(30) Foreign Application Priority Data

May 10, 2013 (GB) ..... 1308439.7
Jan. 27, 2014 (GB) ..... 1401347.8

(51) Int. Cl.
*A47F 3/04* (2006.01)

(52) U.S. Cl.
CPC ..... *A47F 3/0447* (2013.01); *A47F 2003/046* (2013.01)

(58) Field of Classification Search
CPC ..... A47F 3/0447; A47F 3/046; A47F 3/0443; A47F 3/0491; F25D 25/02; F25D 25/028; F25D 17/08; F25D 2317/067
(Continued)

(56) References Cited

U.S. PATENT DOCUMENTS 2,192,562 A 3/1940 Scott
2,539,726 A 1/1951 Claghorn
(Continued)

FOREIGN PATENT DOCUMENTS

CN 102679683 A 9/2012
CN 102706068 A 10/2012
(Continued)

OTHER PUBLICATIONS

Ayres, Timothy Michael; Final Office Action; U.S. Appl. No. 14/890,244, dated May 5, 2017; United States Patent and Trademark Office; Alexandria, VA.
(Continued)

*Primary Examiner* — Joseph Trpisovsky
(74) *Attorney, Agent, or Firm* — Stevens & Showalter, LLP

(57) ABSTRACT

A ducted shelf for an open-fronted display unit employing air curtains comprises a duct extending forwardly or rearwardly through the shelf and communicating at a forward end with a discharge or return opening, the duct being wider in the widthwise direction at the forward end than at a rearward end of the duct. Guide walls divide the duct into a group of channels disposed successively side-by-side in the widthwise direction. Each channel has a respective length reflecting a degree of widthwise offset between the rearward end and the forward end of that channel. A longer channel of the group has a greater width in the widthwise direction at its rearward and forward ends than a shorter channel of the group.

29 Claims, 8 Drawing Sheets

(58) Field of Classification Search
USPC ..... 62/256, 251, 255, 407
See application file for complete search history.

(56) References Cited

U.S. PATENT DOCUMENTS

| | | | | |
|---|---|---|---|---|
| 2,962,875 | A | 12/1960 | Barroero | |
| 3,139,738 | A | 7/1964 | Jarvis | |
| 3,168,818 | A | 2/1965 | Weber | |
| 3,218,822 | A | 11/1965 | Bently et al. | |
| 3,289,432 | A | 12/1966 | Brennan et al. | |
| 3,403,525 | A * | 10/1968 | Beckwith | A47F 3/0447 454/193 |
| 4,314,458 | A | 2/1982 | Hade et al. | |
| 4,671,074 | A | 6/1987 | Gostelow et al. | |
| 4,938,034 | A | 7/1990 | Rosanio et al. | |
| 5,357,767 | A | 10/1994 | Roberts | |
| 5,722,252 | A | 3/1998 | Kang et al. | |
| 6,519,962 | B1 * | 2/2003 | Schuetter | A47F 3/0408 454/193 |
| 6,742,344 | B2 | 6/2004 | Vormedal | |
| 6,971,247 | B2 | 12/2005 | Yamazaki et al. | |
| 7,137,438 | B2 | 11/2006 | Nomura et al. | |
| 9,084,496 | B1 | 7/2015 | Neelagantan et al. | |
| 9,265,359 | B2 | 2/2016 | Wood et al. | |
| 2004/0177634 | A1 | 9/2004 | Yamazaki et al. | |
| 2005/0061758 | A1 | 3/2005 | Nomura et al. | |
| 2006/0199495 | A1 | 9/2006 | Yamaguchi | |
| 2008/0236182 | A1 | 10/2008 | Hahn | |
| 2010/0024446 | A1 | 2/2010 | Rohrer et al. | |
| 2013/0019621 | A1 | 1/2013 | Wood et al. | |
| 2016/0113418 | A1 | 4/2016 | Wood et al. | |
| 2016/0113419 | A1 | 4/2016 | Wood et al. | |

FOREIGN PATENT DOCUMENTS

| | | | |
|---|---|---|---|
| EP | 0589783 | A1 | 3/1994 |
| EP | 2380465 | A1 | 10/2011 |
| JP | S55165468 | A | 12/1980 |
| JP | S56094469 | U | 7/1981 |
| JP | H01305295 | A | 12/1989 |
| JP | H01310294 | A | 12/1989 |
| JP | H0252974 | A | 2/1990 |
| JP | 02058677 | U | 4/1990 |
| JP | 2000028255 | A | 1/2000 |
| JP | 2002318055 | A | 10/2002 |
| JP | 2002356109 | A | 12/2002 |
| JP | 2004261502 | A | 9/2004 |
| JP | 2004267612 | A | 9/2004 |
| JP | 2011225118 | A | 11/2011 |
| WO | 2008052589 | A1 | 5/2008 |
| WO | 2011121284 | A2 | 10/2011 |
| WO | 2011121285 | A1 | 10/2011 |
| WO | 2014181135 | A3 | 11/2014 |
| WO | 2014181136 | A2 | 11/2014 |
| WO | 2014184531 | A1 | 11/2014 |
| ZA | 9806184 | A | 1/1999 |

OTHER PUBLICATIONS

Ayres, Timothy Michael; Office Action; U.S. Appl. No. 14/890,244; dated Oct. 7, 2016; U.S. Patent and Trademark Office; Alexandria, VA.

Tran, Hanh Van; Office Action; U.S. Appl. No. 14/889,898; dated Mar. 23, 2017; U.S. Patent and Trademark Office; Alexandria, VA.

John de Bruijn; International Search Report and Written Opinion of the International Searching Authority dated Aug. 28, 2014, for PCT/GB2014/051453; The International Bureau of WIPO.

Martinez Valero; International Search Report and Written Opinion of the International Searching Authority dated Jan. 27, 2015, for PCT/GB2014/051452; The International Bureau of WIPO.

Martinez Valero; International Search Report and Written Opinion of the International Searching Authority dated Jan. 22, 2015, for PCT/GB2014/051451; The International Bureau of WIPO.

Martinez Valero; International Preliminary Report on Patentability; dated Oct. 14, 2015; PCT/GB2014/051452; European Patent Office.

Martinez Valero; International Preliminary Report on Patentability); dated Jul. 23, 2015; PCT/GB2014/051451; European Patent Office.

Martinez Valero; International Preliminary Report on Patentability; dated Nov. 10, 2015; PCT/GB2014/051453; European Patent Office.

Japanese Notice of Reasons for Rejection; Japanese Patent application No. 2016-512426; dated Apr. 3, 2018; Japan Patent Office; Tokyo, Japan.

Office Action and Search Report; Chinese Patent Application No. 2014800388104; dated Jul. 18, 2018; State Intellectual Property Office of the People's Republic of China.

* cited by examiner

REFRIGERATED DISPLAY APPLIANCES

This invention relates to refrigerated display appliances, exemplified in this specification by refrigerated multi-deck display cases or cabinets that are used in retail premises for cold-storage, display and retailing of chilled or frozen food and drink products.

The invention is not limited to retail food and drink cabinets. For example, the principles of the invention could be used to display other items that require cold storage, such as medicines or scientific items that may be prone to degradation. However, the principles of the invention are particularly advantageous for retail use.

It is well known to fit sliding or hinged glass doors to the front of a refrigerated display cabinet. In theory, but unfortunately not in practice, cold air is held behind the doors, preventing 'cold aisle syndrome' caused by cold air spilling from the open front of the cabinet into an aisle of such cabinets in retail premises. Aside from causing discomfort to shoppers, cold aisle syndrome wastes energy in keeping the cabinets cold and the retail premises warm.

Equipping a refrigerated display cabinet with doors has key disadvantages in a retail environment. Doors put a barrier between the shopper and the displayed items, which can reduce sales very significantly. Doors also create a barrier, and additional work, for staff tasked with restocking, cleaning and maintaining the cabinets, which adds significantly to retail overheads. Also, wider aisles may be needed to allow shoppers to open doors and to manage trolleys, which reduces the sales return per square metre of retail space. Additionally, heat may need to be applied to the doors to reduce fogging and misting following door opening, which increases energy consumption.

Despite incurring these significant disadvantages, doors do not work effectively to retain cold air for the simple reason that shoppers and staff in busy retail premises will open the doors frequently and sometimes for extended periods. Whenever the doors are open, cold dense air will spill out. The cold air lost from inside the cabinet will inevitably be replaced by ambient air. Consequently, in real conditions, the addition of doors to a cabinet does not significantly improve energy consumption, temperature control and ingress of ambient air.

Ingress of ambient air is undesirable during the operation of any refrigerated display appliance. The heat of incoming ambient air increases cooling duty and hence the energy consumption of the appliance. The moisture that the air carries causes condensation, which may also lead to icing. Condensation is unsightly, off-putting and unpleasant for shoppers, may threaten reliable operation of the appliance and promotes microbial activity which, like all life, requires the presence of water. Also, the incoming ambient air will itself contain microbes, dust and other undesirable contaminants.

Specifically, when ambient air that is warm and moist enters the cabinet, it warms items stored within the cabinet and deposits moisture upon them as condensation. Warmer temperatures and higher moisture levels promote microbial activity, which reduces shelf-life, causes off-odours, promotes fungal growth and can cause food poisoning.

Shoppers prefer open-fronted multi-deck display cabinets without doors, as such cabinets provide unhindered access so that the items on display may be easily viewed, accessed and removed for closer inspection and purchase. Retailers also like such cabinets because they allow a wide range of products to be displayed clearly to and accessed easily by shoppers, with reduced maintenance overheads and better utilisation of retail floor space.

Typically, open-fronted refrigerated display cabinets employ a large downwardly-projected refrigerated air curtain extending between discharge and return air terminals from top to bottom over an access opening defined by the open front face of the cabinet. The purposes of the air curtain are twofold: to seal the access opening in an effort to prevent cold air spilling out from the product display space behind; and to remove heat from the product display space that is gained radiantly through the access opening and via infiltration of ambient air into the product display space.

A conventional air curtain requires high velocity to remain stable enough to seal the access opening of the cabinet. Unfortunately, however, high velocity increases the rate of entrainment of ambient air into the air curtain. Entrainment of ambient air drives infiltration of the ambient air into the product display space and contributes to spillage of cold air from the appliance. Also, a high-velocity stream of cold air is unpleasant for a shopper to reach through to access the product display space behind the air curtain.

Additional cooling air is typically supplied via a perforated back panel behind the product display space of the cabinet. That additional cooling air is bled from ducts supplying the air curtain to provide more cooling at each level within that space and to support the air curtain. This allows the air curtain velocity to be reduced and so reduces the entrainment rate of ambient air. However, even with measures such as back panel flow, conventional cabinets can suffer from ambient air entrainment rates as high as 80% in real conditions, causing excessive energy consumption and uncomfortably cold aisles.

Back panel flow has the disadvantage that the coldest air blows over the coldest items at the back of the shelves, which are subject to the lowest heat gain because they are furthest from the access opening. This undesirably increases the spread of temperature across items stored in the product display space. In this respect, it is vital that tight temperature control is maintained throughout the product display space of the cabinet. Regions of a cabinet warmer than the desired temperature will suffer from faster food degradation. Conversely, regions of a cabinet colder than the desired temperature may cycle above and below the freezing point, again promoting faster food degradation.

The levels within a refrigerated display cabinet are typically defined by one or more shelves, which may for example comprise solid or perforated panels or open baskets. Shelves partition the interior of the cabinet into a stack of two or more smaller product display spaces. Shelves and their associated product display spaces may also be partitioned into side-by-side columns. Each product display space is accessible through a respective open frontal access opening. Specifically, each shelf defines an upper access opening above the shelf and a lower access opening below the shelf affording access to refrigerated items in respective product display spaces in a cold-storage volume above and below the shelf.

Several proposals have been made to duct air through shelves of refrigerated display cabinet, to and/or from outlets and/or inlets forwardly-positioned on the shelf, to generate or to support air curtains. The aim is to help air curtains to seal the open front of a cabinet more effectively, improving temperature control and lessening infiltration of ambient air.

In the Applicant's previous patent application published as WO 2011/121284, at least one forwardly-positioned discharge outlet communicates with a supply duct to project cold air as an air curtain across an access opening. At least one forwardly-positioned return inlet communicates with a return duct to receive air from the air curtain. Where the air curtain flows conventionally downwardly from top to bottom, the discharge outlet projects cold air as an air curtain across the lower access opening below the shelf and the return inlet receives air from another air curtain discharged above the shelf across the upper access opening above the shelf.

It is possible, albeit unconventional, for an air curtain to flow upwardly across an access opening from bottom to top. In that case, the discharge outlet projects cold air as an air curtain across the upper access opening and the return inlet receives air from another air curtain discharged below the shelf across the lower access opening. The present invention also encompasses this possibility.

WO 2011/121284 teaches a ducted shelf whose frontal structure comprises a downwardly-facing discharge opening or outlet and an upwardly-facing return opening or inlet. Each of those openings extends parallel to the shelf front and communicates with a respective duct stacked one above the other in the shelf or lying one beside the other in the shelf to supply air to the outlet and to receive air from the inlet.

The Applicant's previous patent application published as WO 2011/121285 discloses the possibility of equally-spaced guide vanes within a supply duct and/or a return duct of a shelf. The purpose of the guide vanes is to distribute air evenly across the width of the shelf with the aim of achieving constant velocity along the length of the laterally-extending discharge and return openings.

Whilst equally-spaced vanes defining channels of equal width across the width of a shelf are possible, they have been found not to provide a sufficiently balanced distribution unless a very large pressure drop is also present at a diffuser such as a honeycomb across a discharge air terminal. Also, many guide vanes are required to produce balanced airflow across the discharge air terminal and a return air terminal.

Where each channel between vanes is of a different length and its hydraulic diameter changes along the length of the channel, this makes it difficult to achieve balanced airflow across the respective air terminals.

It is important that the boundary layer of the air stream remains attached to the vanes on both sides of a channel if the optimal velocity spread is to be provided at the entrance to the transition leading to the discharge air terminal. The air stream may break away from a vane where the divergent angle between the flow direction and the vane is too great, resulting in re-circulation zones and imbalance across the air curtain projected from the discharge air terminal.

As may be expected, increasing the number of guide vanes improves distribution but it does not fully solve the problem. Also, increasing the number of guide vanes is wasteful of material and increases manufacturing costs, especially if the guide vanes are part of a fabricated structure.

It is against this background that the present invention has been devised.

In one sense, the invention resides in a ducted shelf for an open-fronted display unit employing air curtains, the shelf having:

- a front and a back defining a forward direction from back to front and opposed sides defining a widthwise direction from side to side;
- at least one continuous duct extending generally forwardly or rearwardly through the shelf and communicating at a forward end with a discharge or return opening, the duct being wider in the widthwise direction at the forward end than at a rearward end of the duct; and
- guide walls that extend along the duct to divide the duct into a group of pathways disposed successively side-by-side in the widthwise direction, each pathway comprising a respective channel having respective forward and rearward ends, the guide walls splaying forwardly such that the channels are wider in the widthwise direction at their forward ends than at their rearward ends;
- wherein each pathway has a respective length reflecting a degree of widthwise offset between the rearward end and the forward end of the associated channel; and
- a longer pathway of the group has a greater width in the widthwise direction at rearward and forward ends of the associated channel than a shorter pathway of the group.

Preferably, the guide walls defining sides of a channel diverge from a central flow axis through that channel by a maximum of 15°. The guide walls suitably terminate at their forward ends substantially level with the forward end of the duct.

Channels of the group may have different hydraulic diameters. The shelf is preferably arranged such that substantially equal pressure drops are produced across the group of pathways.

Conveniently, the channels are additionally defined by top or bottom walls that join the guide walls. In the embodiments to be described, the top and bottom walls are integral with the guide walls as a unitary airflow guide body, which is preferably moulded, pressed or vacuum-formed. The top and bottom walls may alternate between adjacent channels of the group; for example, the alternating top and bottom walls and guide walls may together define a corrugated or castellated cross-section in the widthwise direction.

Advantageously, the duct tapers forwardly in side section taken front-to-back through the shelf.

The guide walls may comprise central sections that are inclined relative to the front of the shelf in accordance with the degree of widthwise offset between the rearward and forward ends of the associated channels. In the embodiments to be described, the central sections of adjacent guide walls defining a channel splay forwardly. Forward and/or rearward sections of the guide walls may have a lesser inclination than the central sections of the guide walls with respect to the front of the shelf. For example, the forward and/or rearward sections of adjacent guide walls defining a channel may be substantially parallel and may be substantially orthogonal to the front and/or back of the shelf.

The inventive concept also finds expression in airflow guide bodies for ducted shelves. In one example, an airflow guide body of the invention comprises:

- a front and a back defining a forward direction from back to front and opposed sides defining a widthwise direction from side to side;
- formations defining a duct that extends between the front and the back of the body and is wider in the widthwise direction at a forward end than at a rearward end;
- guide walls that extend along the duct to divide the duct into a group of pathways disposed successively side-by-side in the widthwise direction, each pathway comprising a respective channel having respective forward and rearward ends, the guide walls splaying forwardly such that the channels are wider in the widthwise direction at their forward ends than at their rearward ends;

wherein each pathway has a respective length reflecting a degree of widthwise offset between the rearward end and the forward end of the associated channel; and a longer pathway of the group has a greater width in the widthwise direction at rearward and forward ends of the associated channel than a shorter pathway of the group.

The length of a pathway may be measured from the rear of the duct through the associated channel to the front of the duct, or between the rearward and forward ends of a channel.

In another example, an airflow guide body of the invention comprises:

a front and a back defining a forward direction from back to front and opposed sides defining a widthwise direction from side to side;

formations defining a duct that extends between the front and the back of the body and is wider in the widthwise direction at a forward end than at a rearward end; and guide walls that extend along the duct to divide the duct into a group of pathways disposed successively side-by-side in the widthwise direction, each pathway comprising a respective channel having respective forward and rearward ends, the guide walls splaying forwardly such that the channels are wider in the widthwise direction at their forward ends than at their rearward ends;

wherein the channels are additionally defined by top or bottom walls that join the guide walls and that alternate between adjacent channels of the group.

The inventive concept extends to a combination of the airflow guide bodies of the invention, disposed side-by-side as a pair in the widthwise direction, whose duct-defining formations are substantially mirrored about a plane between the guide bodies. Preferably, one guide body of the pair is inverted with respect to the other guide body of the pair.

In the combination, each guide body may comprise: a front and a back defining a forward direction from back to front and opposed sides defining a widthwise direction from side to side; and formations defining a duct that extends between the front and the back of the body, which duct has widthwise offset between a rearward end and a forward end; wherein the combination comprises at least one pair of guide bodies disposed side-by-side in the widthwise direction whose duct-defining formations are substantially mirrored about a plane between the guide bodies. There may be at least two pairs of such guide bodies, each pair having duct-defining formations substantially mirrored about a plane between the guide bodies, wherein: the pairs are disposed one above another; rearward ends of the ducts of a first pair are laterally inward in the widthwise direction; and rearward ends of the ducts of a second pair are laterally outward in the widthwise direction. For example, each pair may comprise one first guide body and one second guide body disposed side-by-side and the lateral positions of the first and second guide bodies are swapped between one pair and the other pair.

The invention extends to a ducted shelf comprising one or more of the airflow guide bodies of the invention or one or more of the combinations of airflow guide bodies of the invention. The invention also embraces an open-fronted display unit comprising at least one shelf of the invention, at least one airflow guide body of the invention or at least one of the combinations of airflow guide bodies of the invention.

In order that the invention may be more readily understood, reference will now be made by way of example to the accompanying drawings, in which.

Figure 1:
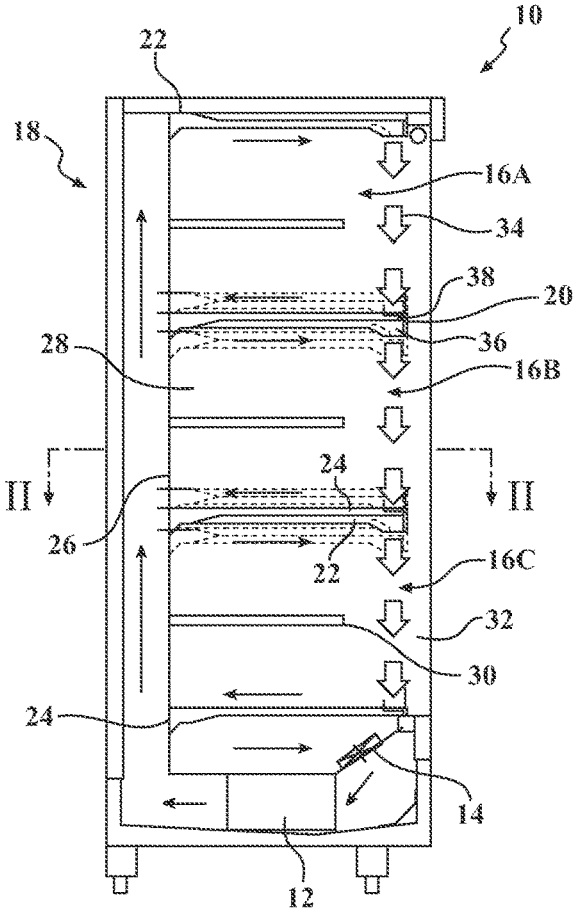
FIG. 1 is a sectional side view of an appliance of the invention, taken on line I-I of FIG. 2.
Figure 2:
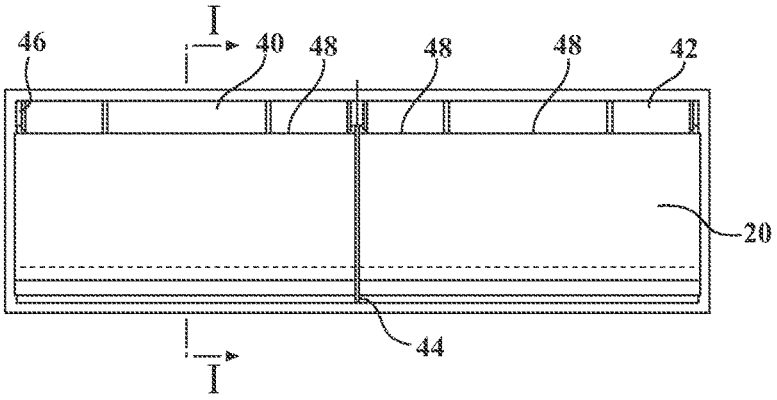
FIG. 2 is a sectional top view of the appliance of FIG. 1, taken on line II-II of FIG. 1.
Figure 3A:
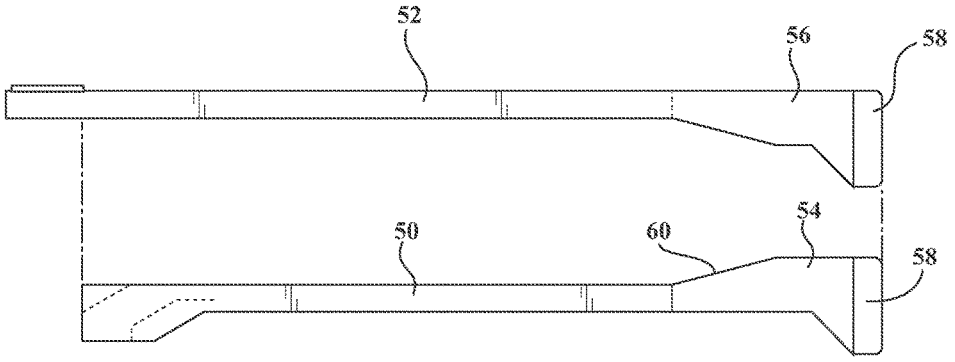
Figure 3B:
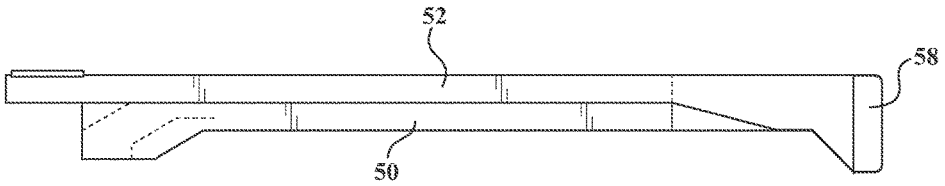
Figure 4B:
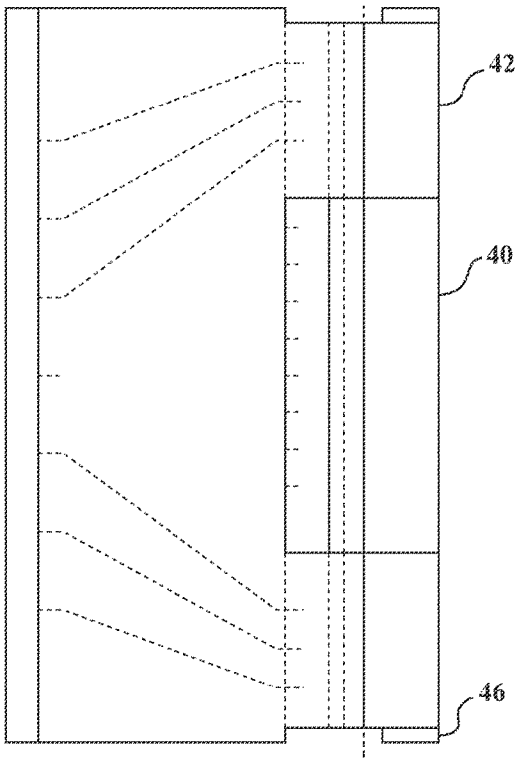
Figure 4A:
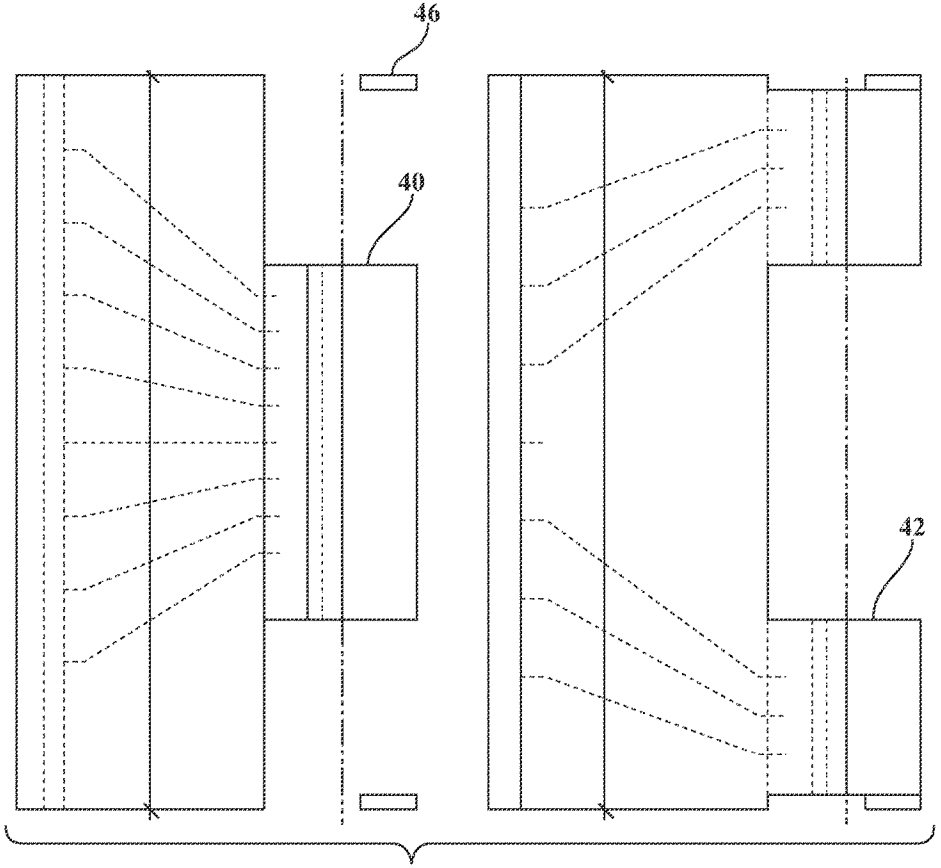
Figure 5:
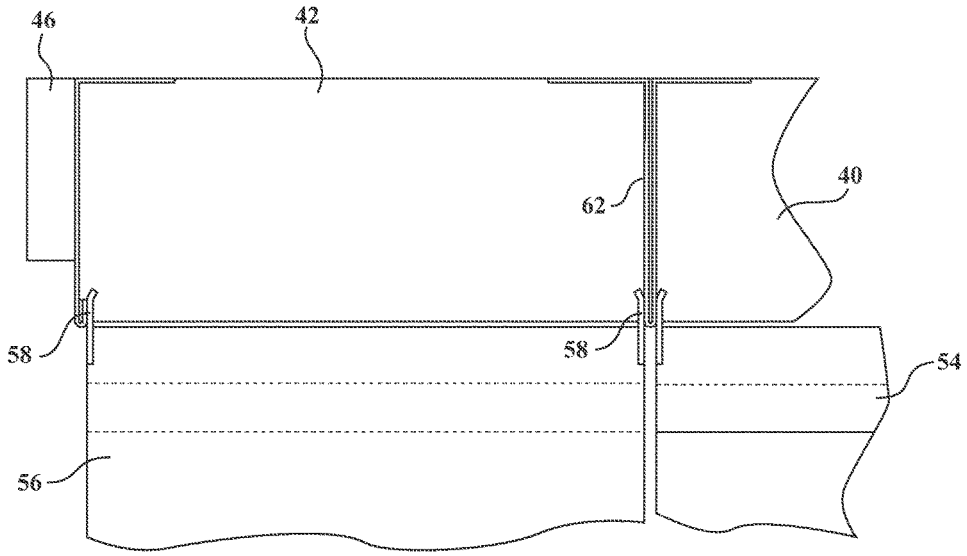
Figure 6:
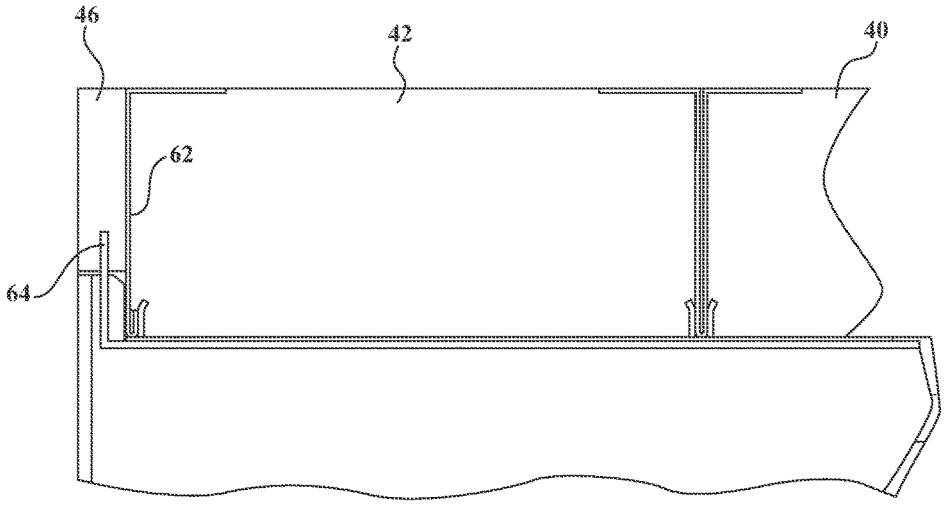
Figure 7:
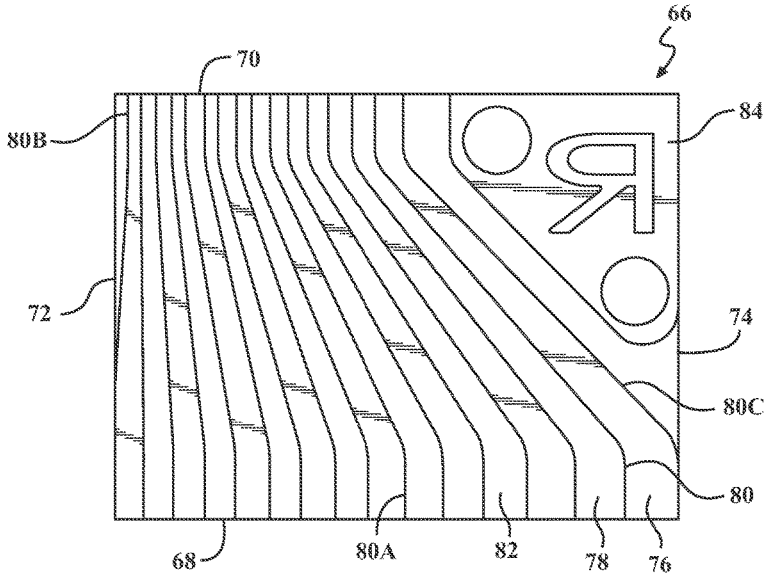
Figure 8:
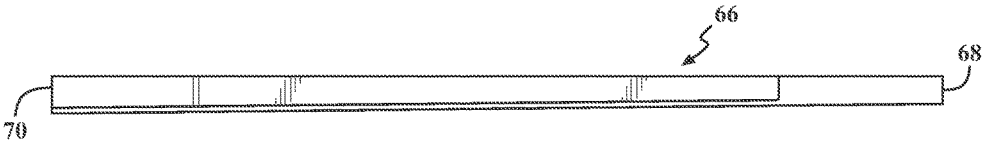
Figure 9:
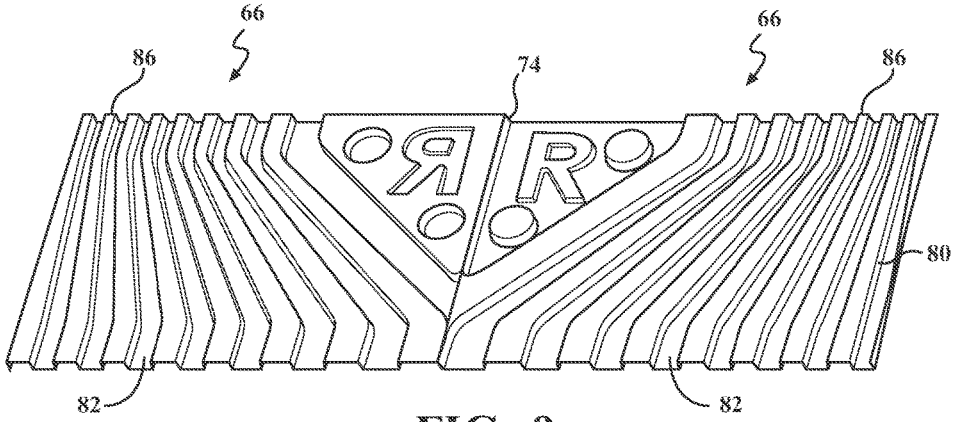
Figure 10:
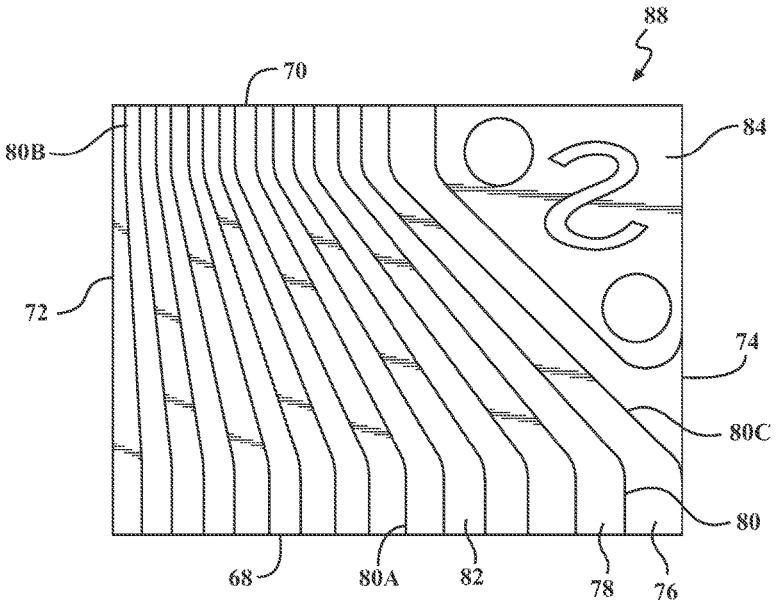
Figure 11:
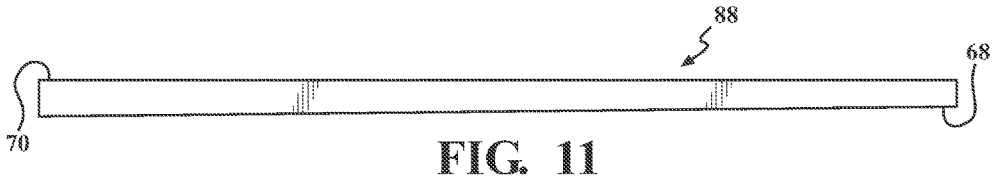
Figure 12:
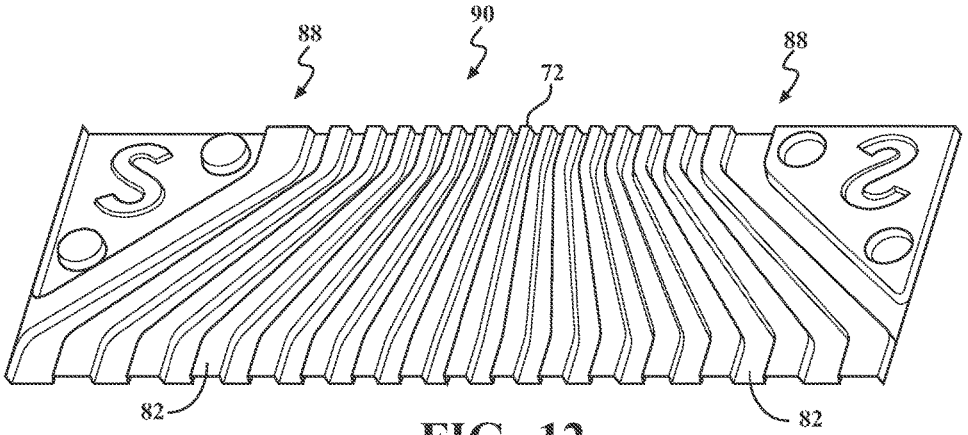
Figure 13A:
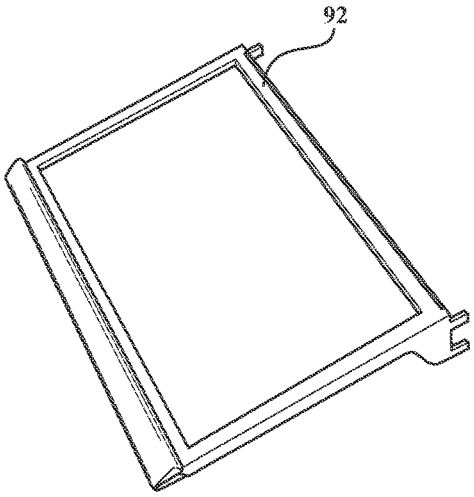
Figure 13B:
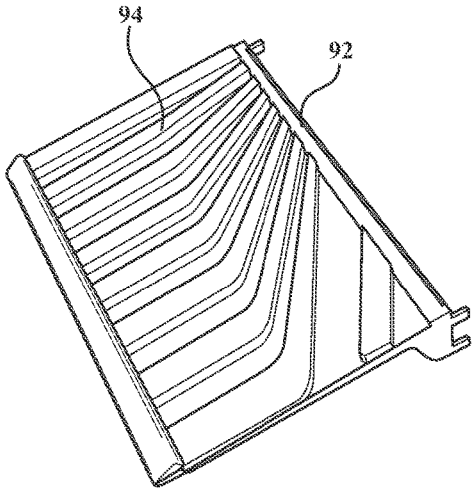

FIG. 3*a* is an exploded side view of a supply duct component and a return duct component of a ducted shelf of the invention;

FIG. 3*b* is a side view of the supply duct component and the return duct component of FIG. 3*a* assembled together;

FIG. 4*a* is an exploded top view of the supply duct component and the return duct component;

FIG. 4*b* is a top view of the supply duct component and the return duct component of FIG. 4*a* assembled together;

FIG. 5 is an enlarged detail view of how the duct components of the shelf couple with riser ducts of the appliance shown in FIGS. 1 and 2;

FIG. 6 is an enlarged detail view corresponding to FIG. 5 and showing how the shelf is supported from keybars of the appliance shown in FIGS. 1 and 2;

FIG. 7 is a perspective view of a vane panel used within the return duct component of the shelf;

FIG. 8 is an enlarged view from the left side of the vane panel of FIG. 7;

FIG. 9 is a perspective view of two of the vane panels of FIGS. 7 and 8, butted together side-by-side for use in a return duct component of the shelf;

FIG. 10 is a perspective view of a vane panel used within the supply duct component of the shelf;

FIG. 11 is an enlarged view from the left side of the vane panel of FIG. 10;

FIG. 12 is a perspective view of two of the vane panels of FIGS. 10 and 11 butted together side-by-side for use in a supply duct component of the shelf;

FIG. 13*a* is a perspective view of a frame for a vane panel of the invention;

FIG. 13*b* is a perspective view showing a vane panel fitted into the frame of FIG. 15*a;*

Figure 14:
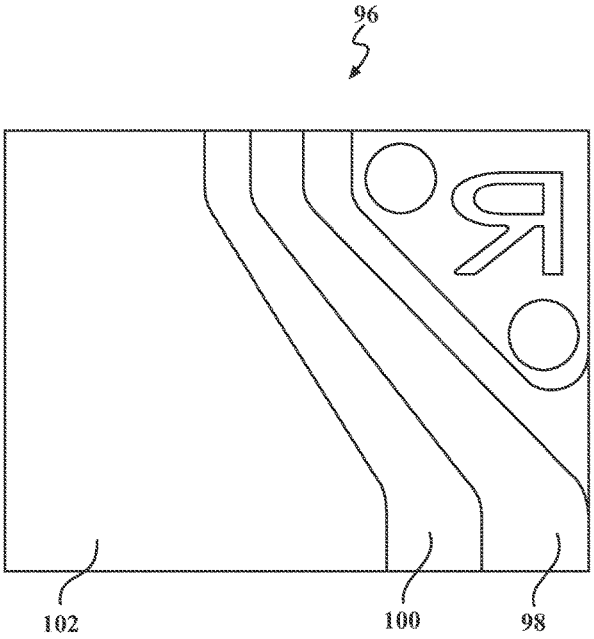
Figure 15:
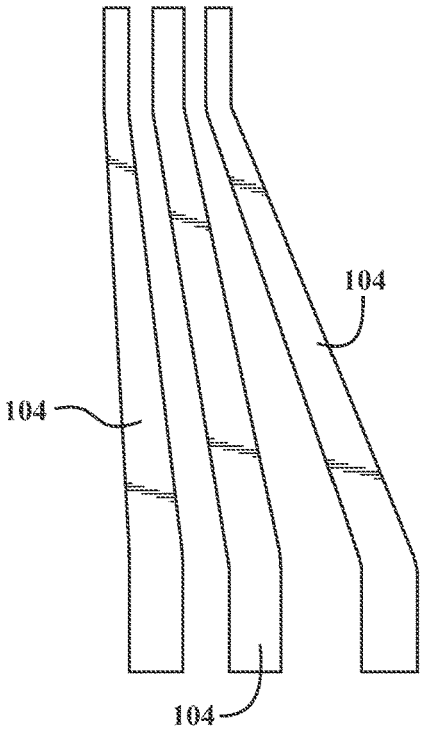
Figure 16:
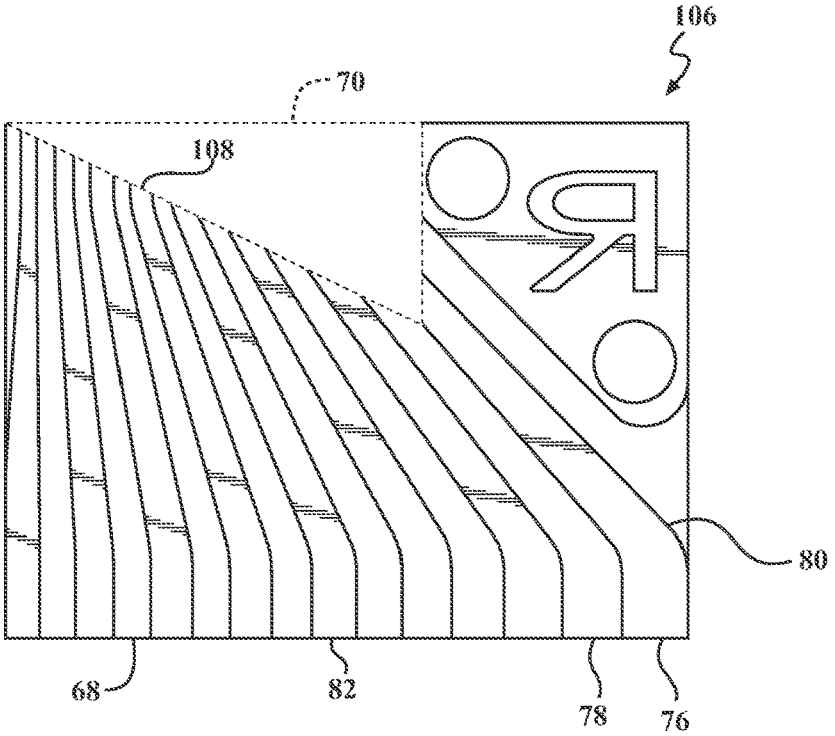

FIG. 14 is a plan view of a further variant of the vane panel;

FIG. 15 is a plan view of channel parts that may be assembled to form a vane panel of a desired size; and FIG. 16 is a plan view of a further variant of the vane panel of the invention.

Referring firstly to FIG. 1, this shows an integrated multi-cellular refrigerated display appliance 10. The appliance 10 has a bottom-mounted evaporator 12 fed with air by supply fans 14, although other arrangements are possible for the production and circulation of cold air. Here, cold air from the evaporator 12 is supplied to a plurality of airflow-managed cells 16A, 16B, 16C that are stacked in a vertical array or column and are all disposed within a single insulated cabinet 18. In this example, there are three cells in the stack, namely a top cell 16A, an inner cell 16B and a bottom cell 16C.

The cells 16A, 16B, 16C are separated here by two ducted shelves 20 constructed in accordance with the invention. The cells 16A, 16B, 16C can be of different heights and may be arranged to store items at different temperatures to reflect storage requirements for various items. The shelves 20 could be fixed but are height-adjustable in this example, as shown by the dashed lines in FIG. 1, so that the relative heights of the cells 16A, 16B, 16C can be adapted to suit different retail requirements.

The ducted shelves 20 each comprise a sandwich of a supply duct 22 and a return duct 24. The shelves 20 subdivide the internal volume of the cabinet 18 into a plurality of product display spaces stacked one atop another, each in its own airflow-managed cell 16A, 16B, 16C. Each shelf 20 defines the top wall of a lower cell in the stack and the bottom wall of an adjacent upper cell in the stack.

The top wall of the top cell 16A is defined by an additional supply duct 22 above a top inner panel of the cabinet 18. Similarly, the bottom wall of the bottom cell 16C is defined by an additional return duct 24 beneath a bottom inner panel of the cabinet 18 that also serves as an additional shelf for the display of refrigerated items. Advantageously, the additional supply duct 22 and the additional return duct 24 may be identical to those used in the shelves 20.

At their back and side edges, the ducted shelves 20 lie closely against the back inner panel 26 and the side walls 28 of the cabinet 18, to discourage airflow around those edges of the shelves 20. Seals may be provided along those edges of the shelves 20 if required.

FIG. 1 also shows optional non-ducted intermediate shelves 30, one at an intermediate level in each cell 16A, 16B, 16C and set back from the front of the ducted shelves 20, to facilitate display of different types of food products and to make best use of the available space. One or more of the intermediate shelves 30 may be perforated or slotted to improve air movement in the cells 16A, 16B, 16C. The intermediate shelves 30 need not seal against the back inner panel 26 or the side walls 28 of the cabinet 18.

Each cell 16A, 16B, 16C is generally in the form of a hollow cuboid or box enclosing a correspondingly-shaped product display space. Front access openings 32 give unhindered reach-in access to any items in the product display spaces defined by the cells 16A, 16B, 16C.

In use, each access opening 32 is sealed by a generally-vertical air curtain 34 that flows downwardly in front of the associated cell 16A, 16B, 16C. The air curtain 34 extends between a downwardly-facing discharge air grille (DAG) or discharge terminal 36 and an upwardly-facing return air grille (RAG) or return terminal 38. Cooled air is supplied through a supply duct 22 to the DAG 36, which projects the air curtain 34, and is returned through a return duct 24 via the RAG 38, which receives air from the air curtain 34. The air received from the air curtain 34 will inevitably include some entrained ambient air, from which heat and moisture must be removed during recirculation within the appliance 10, although the arrangement illustrated will greatly reduce the rate of entrainment in comparison with standard designs.

With reference now also to FIG. 2 of the drawings, the supply ducts 22 and the return ducts 24 that communicate at the front with the DAGs 36 and RAGs 38 respectively communicate at the rear with respective riser ducts 40, 42, namely a supply riser duct 40 and a return riser duct 42. The riser ducts 40, 42 extend upwardly between the back inner panel 26 and the adjacent insulated rear wall of the cabinet 18.

In the example shown in FIG. 2, one supply riser duct 40 is disposed between two return riser ducts 42. FIG. 2 also shows ducted shelves 20 and riser ducts 40, 42 of two columns of cells 16 disposed side-by-side in the common insulated cabinet 18, divided here by a vertical partition 44 that is suitably of transparent material, such as perspex or tempered glass, for ease of viewing.

At its rear edge, the partition 44 lies closely against, and is preferably sealed to, the back inner panel 26. The partition 44 extends from the back inner panel 26 substantially the full depth of the shelves 20 from front to rear. Preferably, as shown, the partition 44 extends slightly forward of the front edges of the shelves 20. The partition 44 prevents air flows from spilling from one column to the next and possibly disrupting the air curtain dynamics of adjacent cells.

The front edge regions of the partition 44 and the shelves 20 may be insulated and/or heated to fight condensation. It is also possible for the front edge regions of the partition 44 and the shelves 20 to be of a low-conductivity material and/or to have a high-emissivity finish.

If shelves 20 of neighbouring columns are aligned in terms of height, the partition 44 may be removed to increase the effective display area.

Another feature shown in FIG. 2 is that each column has pair of keybars 46 that extend vertically on the outer sides of the return riser ducts 42. The keybars 46 support the weight of the shelves 20 and provide a vertical array of slots into which spigots at the back of a shelf 20 can locate at any suitable height. This will be explained in more detail below with reference to FIG. 6.

In use of the appliance 10, cold air is ducted from the evaporator 12 to each cell 16A, 16B, 16C and warmer return air is returned from each cell 16A, 16B, 16C to the coil 14 for cooling, drying, optional filtering and recirculation.

Air is blown through the evaporator 12 by the fans 14 and then propelled up the central supply riser duct 40. From there, the air enters the supply ducts 22 in the ducted shelves 20 and at the top of the cabinet 18 to be projected as a stack of air curtains 34 through the DAGs 36, one per cell 16A, 16B, 16C. The return air from the air curtains 34 is returned via the RAGs 38 and the return ducts 24 in the shelves 20 and at the bottom of the cabinet 18, to enter the return riser ducts 42 on each side of the central supply riser duct 40. The return air flows downwardly in those return riser ducts 42 under the suction of the fans 14 to enter the evaporator 12 again.

The requirement for airflow to the ducted shelves 20 requires ports 48 in the back inner panel 26 leading to the supply riser duct 40 and the return riser ducts 42. Various port arrangements are disclosed in WO 2011/121285 and so need no further elaboration here. For now, it is sufficient to note that those ports 48 are spaced in vertical arrays aligned with the parallel vertically-extending supply riser duct 40 and the return riser ducts 42, to allow for the shelves 20 to be removed and optionally relocated at different heights. Advantageously, those ports 48 are open only when a shelf 20 is coupled with them to reduce unwanted spillage of cold air into the cabinet 18. Again, WO 2011/121285 discloses ways in which the ports 48 could be closed off when not in use; other arrangements are described in parallel patent applications filed by the Applicant.

Referring next to FIGS. 3*a*, 3*b*, 4*a* and 4*b*, these show how separate supply and return duct components 50, 52 respectively are assembled to form a ducted shelf 20 shown in FIGS. 1 and 2. The supply and return duct components 50, 52 are hollow plate-like structures that are laid together in face-to-face relation as part of a ducted shelf 20.

The supply and return duct components 50, 52 have supply and return connectors 54, 56 respectively on their rear edges for connection to respective riser ducts 40, 42 of the appliance 10 shown in FIGS. 1 and 2. Specifically, the connectors 54, 56 are rearwardly-projecting vertically-enlarged extensions of the duct components 50, 52. The connectors 54, 56 employ inclined or curved branch connections to promote even airflow and to minimise static pressure losses. Blade connections 58 at the rear of the connectors 54, 56 facilitate a plug-in arrangement between the connectors 54, 56 and the riser ducts 40, 42 as will be described below in relation to FIG. 5.

The extensions of the respective duct components 50, 52 defining the connectors 54, 56 are offset laterally so as to lie side-by-side and at the same general horizontal level. Specifically, the supply connector 54 is nested between the return connectors 56 when the duct components 50, 52 are assembled together in face-to-face relation as shown in FIGS. 3*b* and 4*b*.

Inclined or curved transition sections between the duct components 50, 52 and the connectors 54, 56 promote even airflow and minimise static pressure losses as air flows through a throat 60 of reduced duct cross-sectional area. This throat 60 creates a relatively high static pressure, which is desirable to balance airflows between shelves. High-velocity contractions defined by the throats 60 and the lateral offset of the connectors 54, 56 reduce duct sizes and help to make airflow more uniform.

FIG. 5 shows how the blade connections 58 at the rear of the connectors 54, 56 plug in to the riser ducts 40, 42 to couple the riser ducts 40, 42 to the supply and return ducts 22, 24 of a ducted shelf 20. The blade connections 58 have resilience that helps them to seal against the side walls 62 of the riser ducts 40, 42 as the blade connections 58 slide into place.

FIG. 5 also shows one of the pair of keybars 46 that extend vertically on the outer sides of the return riser ducts 42 to support the weight of the shelves 20. That keybar 46 is also shown in FIG. 6, which corresponds to FIG. 5 but additionally shows a spigot 64 projecting rearwardly from the shelf 20 and engaged within a slot in the keybar 46. Preferably the keybars 46 provide a vertical array of slots into which spigots 64 of a shelf 20 can locate at any suitable height, to allow the heights of the shelves 20 to be adjusted as required.

Symmetry, balance and airtightness are important aspects of the airflow-managed cells 16A, 16B, 16C used in the invention. Symmetry arises to a considerable extent from the advantageous modularity of the design. In relation to balance, testing has shown that static pressure losses in the vertical riser ducts 40, 42 are insignificant in comparison with the static pressure losses in the ducted shelves 20 and in the throats 60 leading to or within the shelves 20. Consequently, the relative positions of different shelves 20 along the riser ducts 40, 42 will have little bearing on the system balance. This means that air will flow substantially equally to and from each shelf 20 regardless of its vertical position along the riser ducts 40, 42.

Turning next to FIG. 7 of the drawings, this shows a vane panel 66 that is arranged to direct airflow inside the return duct 24 of a ducted shelf 20. In this example, the vane panel 66 is generally oblong in plan view and has a straight front edge 68, a straight rear edge 70 parallel to the front edge 68, and straight side edges 72, 74 extending orthogonally with respect to the front and rear edges 68, 70.

The vane panel 66 shown in FIG. 7 has a castellated sideways cross section comprising alternating upper and lower webs 76, 78 interspersed with upstanding side walls 80 that join the upper and lower webs 76, 78. The upper and lower webs 76, 78 increase in width in a direction from the side edge 72 shown to the left in FIG. 7 toward the side edge 74 shown to the right in FIG. 7. The spacing between the side walls 80 therefore increases in the same direction, whereas the height of the side walls 80 remains substantially the same across the width of the vane panel 66.

When the vane panel 66 is placed within a return duct component 52 of a ducted shelf 20, parallel upper and lower panels of the hollow duct component 52 will close off the gaps between adjacent upper webs 76 and between lower webs 78. In this way, adjacent pairs of side walls 80 define continuous air channels 82 between them, providing pathways for air to flow across the vane panel 66. By virtue of its castellated cross-section, the pathways comprising the channels 82 alternate between upper and lower faces of the vane panel 66.

The channels 82 extend between the front edge 68 and the rear edge 70 of the vane panel 66 shown in FIG. 7. In use in a return duct 24, the channels 82 carry air that flows along a pathway extending from the front edge 68 to the rear edge 70. The side walls 80 are shaped to serve as vanes to direct the air flow laterally across the vane panel 66 as the air traverses the vane panel 66 from front to rear.

The channels 82 extend generally between the front edge 68 and the rear edge 70 of the vane panel 66. In this example, the channels 82 extend the full front-to-rear depth of the panel 66 although in other variants, the side walls 80 and the channels 82 may terminate short of the front and/or rear edges 68, 70. In that case, chambers may be defined at the ends of the channels 82 when the vane panel 66 is sandwiched between parallel upper and lower panels of the hollow duct component 52. The air pathways then extend through those chambers and the channels 82.

The channels 82 separated by the side walls 80 are spaced along substantially the full length of the front edge 68, in other words substantially across the full width of the vane panel 66 at the front. The side walls 80 converge rearwardly and are generally inclined toward one side of the vane panel 66, such that the channels 82 are offset laterally toward the rear of the vane panel 66, thus being gathered toward one end or side of the rear edge 70 adjacent the side edge 72.

A generally triangular filler formation 84 in one corner of the vane panel 66 between the rear edge 70 and the opposite side edge 74 closes off the portion of the rear edge 70 where there are no channels 82.

The side walls 80 have forward parallel sections 80A, rearward parallel sections 80B and central forwardly-splayed sections 80C, such that the spacing between the side walls 80 is greater at the forward parallel sections 80A than at the rearward parallel sections 80B. It follows that the channels 82 defined between adjacent side walls 80 widen forwardly in plan view, at least between the sections 80C of the side walls 80.

The side walls 80 are smoothly curved at the transitions between the forward sections 80A and the central sections 80C, and between the central sections 80C and the rearward sections 80B.

The inclination of the central sections 80C of the side walls 80 with respect to the front edge 68 of the vane panel 66 decreases toward the side edge 72 shown to the left in FIG. 7, toward which the channels 82 converge rearwardly. In other words, the inclination of the central sections 80C of the side walls 80 with respect to the front edge 68 of the vane panel 66 increases toward the opposite side edge 74. This progressively-incrementing inclination of the central sections 800 of the side walls 80 in a widthwise direction is a consequence of the lateral offset of the channels 82 toward the rear of the vane panel 66 versus the wider and more regular distribution of the channels 82 toward the front of the vane panel 66.

It will be apparent from the foregoing that the channels 82 toward the side edge 74 shown to the right in FIG. 7 are both longer and wider than the channels 82 toward the side edge 72 shown to the left in FIG. 7. The spacing between the side walls 80 and consequently the width of the channels 82 increases in this direction along both the front and the rear of the channels 82.

At the forward sections 80A and the rearward sections 80B, the side walls 80 are preferably parallel as shown but they need not be. In more general terms, the forward sections 80A and the rearward sections 80B of the side walls 80 have a lesser inclination than the central sections 80C of the side walls 80 with respect to the front edge 68 of the vane panel 66. Indeed, in this example, the forward parallel sections 80A and the rearward parallel sections 80B of the side walls 80 are generally orthogonal to the front edge 68 and the rear edge 70 of the vane panel 66.

The longest side wall 80 at the end of the row, shown to the extreme right in FIG. 7, has the greatest inclination with respect to the front edge 68 of the vane panel 66. A projection of the central section 80C of that side wall 80 intersects the adjacent side edge 74, while the forward section 80A of that side wall follows that side edge 74.

FIG. 8 shows that the height or thickness of the vane panel 66 defined by the height of the side walls 80 tapers slightly from the rear edge 70 to the front edge 68. This improves air flow; it also beneficially enables the thickness of the front of a ducted shelf 20 to be reduced, maximising the size of the front access openings 32 of the appliance 10 and improving visibility of its product display spaces.

The vane panel 66 shown in FIGS. 7 and 8 defines a half-set of channels 82. A full set of channels 82 that extends across substantially the full width of the front of a shelf 20 is created when two of the vane panels 66 are put together to abut side-by-side along their side edges 74, as shown in FIG. 9. It will be noted here that one vane panel 66 is inverted with respect to the other vane panel 66, beneficially enabling identical mouldings to be used for both vane panels 66 while maintaining a continuous castellated cross-section that defines the channels 82.

It will be apparent from FIG. 9 that when the vane panels 66 are combined in this way, the half-sets of channels 82 of those panels 66 splay away from each other to the outer rear corners of the oblong combination. In this way, the half-sets define respective rear outlets 86 aligned with the return riser ducts 42 that are disposed laterally outwardly with respect to the supply riser duct 40 of the appliance 10.

The thin side walls 80 adjacent the side edges 74 of the combined vane panels 66 abut along their forward sections 80A, leaving an uninterrupted sequence of channels 82 across the front of the combination because one vane panel 66 is inverted with respect to the other.

FIGS. 10, 11 and 12 correspond to FIGS. 7, 8 and 9 respectively but show vane panels 88 that are arranged to direct airflow inside the supply duct 22 of a ducted shelf 20. The shape and construction of the vane panels 88 are essentially the same as for the vane panels 66 shown in FIGS. 7 to 9, and so will not be described afresh so as to avoid repetition. Instead, like numerals are used for like parts. Indeed, in some arrangements, it would be possible for the vane panels 88 used in the supply duct 22 to be identical to the vane panels 66 used in the return duct 24 and therefore to be identical mouldings, further to the benefit of tooling costs.

In use, the channels 82 of the vane panels 88 in the supply duct 22 carry air that flows from the rear edge 70 to the front edge 68. Otherwise, the differences in the vane panels 88 over the vane panels 66 of the return duct 24 lie mainly in their abutting combination as shown in FIG. 12. Here, two of the vane panels 88 are instead assembled to abut side-by-side along their side edges 72, with one vane panel 88 again being inverted with respect to the other vane panel 88.

It will be apparent from FIG. 12 that when the vane panels 88 are combined in this way, the half-sets of channels 82 of those panels 88 converge rearwardly and conjoin to define a central rear inlet 90 that is aligned with the supply riser duct 40 of the appliance 10. Again, the thin side walls 80 adjacent the side edges 72 of the combined vane panels 88 abut to provide an uninterrupted sequence of channels 82 across the front of the combination, because one vane panel 88 is inverted with respect to the other.

When vane panels 66, 88 are combined as shown in FIGS. 9 and 12 to suit a full-width ducted shelf 20, the result is a total of thirty channels 82 across the shelf width in this example. Usually there will be at least ten such channels 82 in a ducted shelf 20, which is shallow in height or thickness compared to its width.

The eccentric in-line expansions and contractions effected by the vane panels 66, 88 are to be distinguished from 90° bends or elbows used, for example, in HVAC installations. In HVAC ducts employing splitters or turning vanes at elbows and bends, it is not an objective to maintain equal velocity at the discharge of the fitting. Instead, the main objective is to reduce static pressure losses, allowing velocity variations to balance out further downstream. In contrast, the present invention aims for uniform velocity across the entire linear width of the vane panel discharge.

The purpose of the guide vanes defined by the side walls 80 of the vane panels 66, 88 is to distribute air evenly across the width of a ducted shelf 20, aiming for a substantially constant velocity across the width of the DAG 36 and the RAG 38. The pressure drop through the channels 82 and the throats 60 of each shelf 20 should, if possible, be identical from shelf 20 to shelf 20 to ensure an evenly-balanced distribution of air between all of the shelves 20. That pressure drop should also be large compared to common duct pressure losses and the 'stack effect', which arises from pressure forces acting on an air curtain due to the effect of temperature on the buoyancy of air.

A sudden expansion from the riser supply duct 40 into the full width of the shelf 20 would not generate a smooth and evenly-distributed flow across the width of the shelf 20. Instead, most of the air would discharge at the centre of the shelf 20 and recirculation would occur at the sides of the shelf 20 unless a plenum chamber is created. Vanes defined by the side walls 80 of the vane panels 66, 88 eliminate or reduce the need for, or the size of, a plenum at the DAG 36 and RAG 38.

To minimise the power consumption of the fans 14 and the thickness of the shelves 20, it is desirable not to form a true plenum chamber behind the DAG 36. It is not possible to use a plenum behind the RAG 38.

Typically a pressure drop of 20 Pa through the shelf 20 and any attached diffuser such as a honeycomb is adequate to balance the flow between cells 16A, 16B, 16C operating from the same riser ducts 40, 42.

The invention enables various performance criteria to be achieved that determine an efficient and cost-effective shelf air guide for airflow-balanced cells, in particular:

- achieving substantially equal pressure drop between air channels 82 regardless of their length and variations in their hydraulic diameter;
- ensuring that the air stream remains attached to both adjacent side walls 80 of a channel 82 to provide an optimal velocity spread at the entrance to the transition leading to the DAG 36;
- preventing the boundary layer of the air stream breaking away from a side wall 80 by maintaining a divergent angle between the flow direction and the side wall not exceeding 7 to 15°, more preferably 7° to 12° and most preferably 7° to 10°; and
- counter-intuitively, minimising the number of channels 82 while keeping the geometry as simple as possible.

The foregoing description refers to three rear riser ducts 40, 42 to distribute air to the ducted shelves 20, namely one supply riser duct 40 and two return riser ducts 42. In that arrangement, there are two vane panels 66, 88 in a mirrored arrangement in each of the supply and return ducts 22, 24. That arrangement works well for the most common refrigerated display cabinets, in which a standard shelf width is about 1200 mm. In some refrigerated display cabinets, however, each shelf is much narrower—say only 600 mm wide.

For such narrow shelves, it may not be practical or viable to scale down the three-duct distribution system comprising one supply riser duct 40 between two return riser ducts 42. However, such a narrow shelf could instead suit the use of one vane panel 66, 88 in each of the supply and return ducts 22, 24. This would be apt for a simplified two-duct distribution system comprising one supply riser duct 40 beside one return riser duct 42. Reference is made in this respect to FIGS. 13*a* and 13*b*, the former showing a frame 92 for supporting a single vane panel and the latter showing a single vane panel 94 fitted into the frame 92.

A vane panel may have a modular construction so that a standard moulding can be trimmed to suit different shelf widths. Alternatively a mould tool could be made modular so that additional sections can be added to the tool for greater shelf widths. In this respect, FIG. 14 shows how a mould tool 96 can be built up to suit the desired shelf width as indicated by the add-on sections 98, 100 and 102.

Trimming the vane panels to accommodate different sizes of shelves is possible but that option limits the shelf widths that may be accommodated. An alternative tooling arrangement to cater for different shelf widths is to have individual tools 104 defining each air channel as shown in FIG. 15. These channel tools 104 can be set in a jig to make up the desired shelf width. The advantage of this arrangement is that the gap between the individual channel tools 104 can be adjusted to provide even more flexible dimensioning.

If the channels are defined by separate mouldings set side by side, it is straightforward to configure different shelf widths. If only every alternate channel is formed by a moulding, the space between the channels may be adjusted; this gives considerable flexibility to achieve roughly 2:1 inlet/outlet ratios for a large range of shelf widths. Also, the front-to-back depth of the vane panel may be trimmed.

Turning finally to FIG. 16 of the drawings, this shows a vane panel 106 that is a variant of the vane panel 66 used in the return duct 24 as shown in FIGS. 7 to 9. Again, like numerals are used for like parts. In this variant, a triangular cut-out in the rear of the vane panel 106 has an inclined edge 108 that slants forwardly from the narrower channels 82 shown to the left in FIG. 16 to the wider channels 82 shown to the right in FIG. 16.

Significant static pressure losses occur at the throats 60, which losses may be reduced by increasing the free cross-sectional area of the throats 60. One way to do that is to reduce the amount of material in the walls dividing the channels 82, each of which may be several millimetres thick. FIG. 16 shows a way in which that objective may be achieved. This may be particularly helpful where the expansion ratio from inlet to outlet causes very high static pressures in the throats 60.

The overall static pressure loss for the air channels 82 will be determined by the channel 82 defining the longest run and therefore with the most pronounced offset; this is typically referred to as the 'index run'. The short channels 82 on the other side of a vane panel that are nearly straight, and the intermediate-length, less-offset channels 82 in between, are throttled with the aim of achieving a pressure drop and discharge velocity that are substantially equal to those of the index run.

In effect, the inclined edge 108 of the cut-out terminates the channels 82 inboard of where the rear edge 70 would extend but for the cut-out, as marked by the dashed line in FIG. 16. The inclination of the edge 108 terminates the channels 82 in a stepwise manner such that the narrower channels 82 shown to the left in FIG. 16 terminate at their rear further from the front edge 68 than do the wider channels 82 shown to the right in FIG. 16. Nevertheless, when the vane panel 106 is installed in a return duct 24 of a ducted shelf 20, the effective length of the wider channels 82 as measured from the front edge 68 to the rear of the return duct 24 corresponding to the rear edge 70 remains greater than the length of the narrower channels 82. In this respect, it is noted that, in use, the vane panel 106 will be sandwiched between parallel upper and lower panels of the hollow duct component 52, which will constrain air flow despite the cut-out.

A similar cut-out feature may be applied to a vane panel 88 that is arranged to direct airflow inside the supply duct 22 of a ducted shelf 20.

During assembly, strips or layers of insulation can be added between the supply and return duct components 50, 52 to reduce heat transfer between the supply and return ducts 22, 24. Adjoining walls and their surfaces between the supply and return duct components 50, 52 in the shelf 20 at different temperatures should be of low heat-conducting materials and/or insulated and/or heated to discourage condensation in the warmer duct. The warmer duct is normally the return duct 24, where infiltration gains will tend to raise moisture levels; proximity to the colder supply duct 22 could otherwise encourage that moisture to condense.

Insulation may be placed on the shelf 20 to avoid over-cooling of any products placed on the shelf 20. Alternatively, over-cooling may be avoided by the use of less conductive material and/or by fitting the shelf 20 with an insulating plate, cover or mat, or a spacer such as a wire stand-off shelf. Conversely if it is desired to use conduction cooling to cool items supported by the shelf 20, a heat-conducting plate or cover may be placed on the shelf 20 instead.

Part-length vanes may be disposed in the channels 82 between full-length side walls 80.

As an alternative to using two smaller components side-by-side, each comprising a half-set of channels, a single component such as a plastics moulding may of course be used to define all of the channels required in each duct.

Many other variations are possible within the inventive concept. For instance, in other examples having more than three cells in the stack, there will be more than one inner cell and more than two ducted shelves; conversely where there are only two cells in the stack, there will be no inner cell and only one ducted shelf.

The castellated sideways cross section of a vane panel is merely one way of defining air channels extending across the panel. Another option is to provide an array of side walls upstanding from a generally flat panel, defining a series of U-shaped channels whose open tops are closed by a panel of a hollow duct component into which the vane panel is placed.

Vane panels may have formations cooperating with complementary formations in the correct receiving duct or shelf to ensure that they cannot be incorrectly installed in the wrong duct or shelf or in the wrong orientation.

One or both of the side walls of the cabinet could be transparent to enhance visibility of the items displayed in the product display spaces, in which case the side walls are suitably of tempered glass or perspex and double- or triple-glazed to maintain good insulation.

The appliance need not have an internal refrigerator engine if cold air is produced elsewhere, for example in a remote fan coil unit, and pumped to the appliance. Thus, the refrigerator engine can be included in the cabinet as an integral unit or cooling can be supplied remotely from a typical supermarket refrigeration pack unit. Local cooling necessitates a drainage system for condensate water.

To deal with any condensation that may form in a ducted shelf, such shelves may be provided with drains to collect moisture and to drain it away. For example, a return duct in a ducted shelf could be inclined downwardly and rearwardly to fall toward the rear of the cabinet, where it may lead water to a drainage system that is provided for the evaporator to reject water from the cabinet.

If used in the appliance, cooling coils and fans may be located behind the cells but could instead be situated to the top, bottom or sides of the cells.

A single return duct may be located above a single supply duct in a bi-level layered or sandwiched arrangement in each shelf. However, other arrangements are possible in which the return duct is beside the supply duct, on the same horizontal level or on overlapping levels in the shelf. Also, there may be more than one supply duct or return duct per shelf, or those ducts may be divided into branches.

The vane panels described above could be fabricated from metal, such as by fabrication of steel vanes or by insertion of plastics or steel vanes into a milled path. However, the vane panels are preferably of plastics and may be thermoformed, vacuum-formed, blow-moulded or injection-moulded for accurate and low-cost manufacture. Another possibility is to produce the vane panels by 3D printing.

Thermoforming of plastics has the advantage of accuracy of the guide vanes when manufactured, as opposed to fabrication and hand measurement which depends upon human skill. However thermoforming has challenges, for example with regard to material thinning and shrinkage after moulding. This is another reason why it is desirable to have modular tooling, so that different shelf sizes can be developed from a single known set of tooling.

The multi-channel vane panel arrangement of the invention ensures accurate fabrication, repeatable accuracy and simple assembly. It ensures even air velocity distribution to and from wide DAGs and RAGs, enabling expansion or contraction to or from narrower connections to riser ducts.

The invention claimed is:

1. A ducted shelf for an open-fronted display unit employing air curtains, the shelf having:

a front and a back defining a forward direction from back to front and opposed sides defining a widthwise direction from side to side;

at least one continuous duct extending generally forwardly or rearwardly through the shelf and communicating at a forward end with a discharge or return opening, the duct being wider in the widthwise direction at the forward end than at a rearward end of the duct; and guide walls that extend along the duct to divide the duct into a group of pathways disposed successively side-by-side in the widthwise direction, each pathway comprising a respective channel having respective forward and rearward ends, the guide walls splaying forwardly such that the channels are wider in the widthwise direction at their forward ends than at their rearward ends;

wherein each pathway has a respective length reflecting a degree of widthwise offset between the rearward end and the forward end of the associated channel;

a longer pathway of the group has a greater width in the widthwise direction at rearward and forward ends of the associated channel than a shorter pathway of the group; and the width of the channels increases in the widthwise direction along both the forward and rearward ends of the channels.

2. The shelf of claim 1, wherein the guide walls defining sides of a channel diverge from a central flow axis through that channel by a maximum of 15°.

3. The shelf of claim 1, wherein the guide walls terminate at their forward ends substantially level with the forward end of the duct.

4. The shelf of claim 1, wherein the channels of the group of pathways have different hydraulic diameters.

5. The shelf of claim 1 and being arranged such that substantially equal pressure drops are produced across the group of pathways.

6. The shelf of claim 1, wherein the channels are additionally defined by top or bottom walls that join the guide walls.

7. The shelf of claim 6, wherein the top and bottom walls are integral with the guide walls as a unitary airflow guide body.

8. The shelf of claim 7, wherein the airflow guide body is moulded, pressed or vacuum-formed.

9. The shelf of claim 6, wherein the top and bottom walls alternate between adjacent channels of the group of pathways.

10. The shelf of claim 9, wherein the alternating top and bottom walls and guide walls together define a corrugated or castellated cross-section in the widthwise direction.

11. The shelf of claim 1, wherein the duct tapers forwardly in side section taken front-to-back through the shelf.

12. The shelf of claim 1, wherein the guide walls comprise central sections inclined relative to the front of the shelf in accordance with the degree of widthwise offset between the rearward and forward ends of the associated channels.

13. The shelf of claim 12, wherein the central sections of adjacent guide walls defining a channel splay forwardly.

14. The shelf of claim 12, wherein forward and/or rearward sections of the guide walls have a lesser inclination than the central sections of the guide walls with respect to the front of the shelf.

15. The shelf of claim 14, wherein the forward and/or rearward sections of adjacent guide walls defining a channel are substantially parallel.

16. The shelf of claim 14, wherein the forward and/or rearward sections of the guide walls are substantially orthogonal to the front and/or rear of the shelf.

17. The shelf of claim 1, wherein the length of each pathway is measured from the rear of the duct through the associated channel to the front of the duct.

18. The shelf of claim 17, wherein the length of each pathway is measured between the rearward and forward ends of each associated channel.

19. An open-fronted display unit comprising at least one shelf as defined in claim 1.

20. An airflow guide body for a ducted shelf, the guide body comprising:

a front and a back defining a forward direction from back to front and opposed sides defining a widthwise direction from side to side;

formations defining a duct that extends between the front and the back of the body and is wider in the widthwise direction at a forward end than at a rearward end;

guide walls that extend along the duct to divide the duct into a group of pathways disposed successively side-by-side in the widthwise direction, each pathway comprising a respective channel having respective forward and rearward ends, the guide walls splaying forwardly such that the channels are wider in the widthwise direction at their forward ends than at their rearward ends;

wherein each pathway has a respective length reflecting a degree of widthwise offset between the rearward end and the forward end of the associated channel; and a longer pathway of the group has a greater width in the widthwise direction at rearward and forward ends of the associated channel than a shorter pathway of the group; and the width of the channels increases in the widthwise direction along both the forward and rearward ends of the channels.

21. The airflow guide body of claim 20, wherein the length of each pathway is measured from the rear of the duct through the associated channel to the front of the duct.

22. A combination of airflow guide bodies of claim 20 disposed side-by-side as a pair in the widthwise direction, whose duct-defining formations are mirrored about a plane between the guide bodies.

23. The combination of guide bodies of claim 22, wherein one guide body of the pair is inverted with respect to the other guide body of the pair.

24. A ducted shelf comprising one or more of the airflow guide bodies of claim 20.

25. An open-fronted display unit comprising at least one airflow guide body as defined in claim 20.

26. A ducted shelf comprising one or more of the combinations of claim 22.

27. An open-fronted display unit comprising at least one combination as defined in claim 22.

28. A combination of airflow guide bodies for a ducted shelf, each guide body comprising:

a front and a back defining a forward direction from back to front and opposed sides defining a widthwise direction from side to side; and formations defining a duct that extends between the front and the back of the body, which duct has widthwise offset between a rearward end and a forward end;

wherein:

the combination comprises at least two pairs of guide bodies, the guide bodies of each pair being disposed side-by-side in the widthwise direction;

each pair having duct-defining formations mirrored about a plane between the guide bodies;

the pairs are disposed one above another;

rearward ends of the ducts of a first pair are laterally inward in the widthwise direction; and rearward ends of the ducts of a second pair are laterally outward in the widthwise direction.

29. The combination of claim 28, wherein each pair comprises one first guide body and one second guide body disposed side-by-side and lateral positions of the first and second guide bodies are swapped between one pair and the other pair.

* * * * *